US005657570A

United States Patent [19]

Sigier Emmanuel

[11] Patent Number: 5,657,570

[45] Date of Patent: Aug. 19, 1997

[54] DEVICE FOR MAINTAINING THE INNER SURFACE OF GUN BARRELS AND METHOD FOR PRODUCING SAME

[76] Inventor: Jean-Luc Henri Sigier Emmanuel, 71 Rue Pierre Mendes France, 59560 Comines, France

[21] Appl. No.: 569,126

[22] PCT Filed: Jul. 4, 1994

[86] PCT No.: PCT/FR94/00816

§ 371 Date: Jan. 3, 1996

§ 102(e) Date: Jan. 3, 1996

[87] PCT Pub. No.: WO95/02162

PCT Pub. Date: Jan. 19, 1995

[30] Foreign Application Priority Data

Jul. 6, 1993 [FR] France ..... 93 08532

[51] Int. Cl.[6] ..... F41A 29/02

[52] U.S. Cl. ..... 42/95

[58] Field of Search ..... 42/95, 106, 96; 15/104.165, 104.05

[56] References Cited

U.S. PATENT DOCUMENTS

| | | | |
|---|---|---|---|
| 621,857 | 3/1899 | Scott | 15/104.165 |
| 1,061,119 | 5/1913 | P'Pool | 15/104.165 |
| 1,337,104 | 4/1920 | Sullivan | 15/104.165 |
| 1,577,423 | 3/1926 | Mugaas | 15/104.165 |
| 2,070,844 | 2/1937 | Riley | 15/104.165 |
| 2,544,847 | 3/1951 | Malesky | 15/104.165 |
| 2,774,090 | 12/1956 | Allinson | 15/104.165 |
| 3,301,931 | 1/1967 | Morin | 264/145 |
| 3,512,223 | 5/1970 | Willinger | 403/209 |
| 4,010,565 | 3/1977 | DiProspero | 42/106 |
| 4,674,218 | 6/1987 | Bottomley | 42/95 |
| 4,716,673 | 1/1988 | Williams et al. | 42/95 |
| 5,171,925 | 12/1992 | Mekler | 42/95 |
| 5,357,705 | 10/1994 | Stengel | 42/95 |

FOREIGN PATENT DOCUMENTS

| | | | |
|---|---|---|---|
| 383520 | 10/1923 | Germany | 15/104.165 |
| 3627084 | 2/1988 | Germany . | |
| 410549 | 3/1966 | Switzerland | 403/212 |
| 119125 | 9/1918 | United Kingdom | 15/104.2 |

*Primary Examiner*—Michael J. Carone
*Assistant Examiner*—Matthew J. Lattig
*Attorney, Agent, or Firm*—William L. Feeney; Kerkam, Stowell, Kondracki & Clarke, P.C.

[57] ABSTRACT

A device to clean inner surfaces of gun barrels includes a movable member. The member has an elongate body with two ends. The body has an essentially uniform cross section such that the body can be loosely fitted within a barrel of a given inside diameter. The body has a folded cord in it. The cord extends out of the body to a closed loop at one end and a handle at another end.

10 Claims, 2 Drawing Sheets

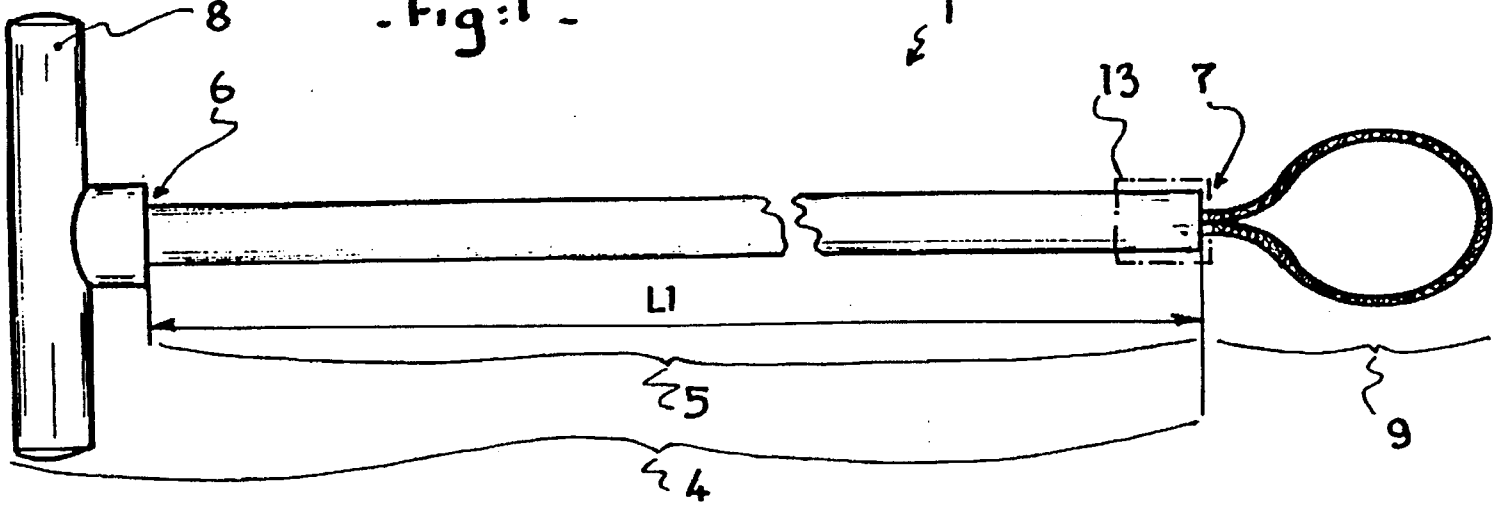
-Fig:1-
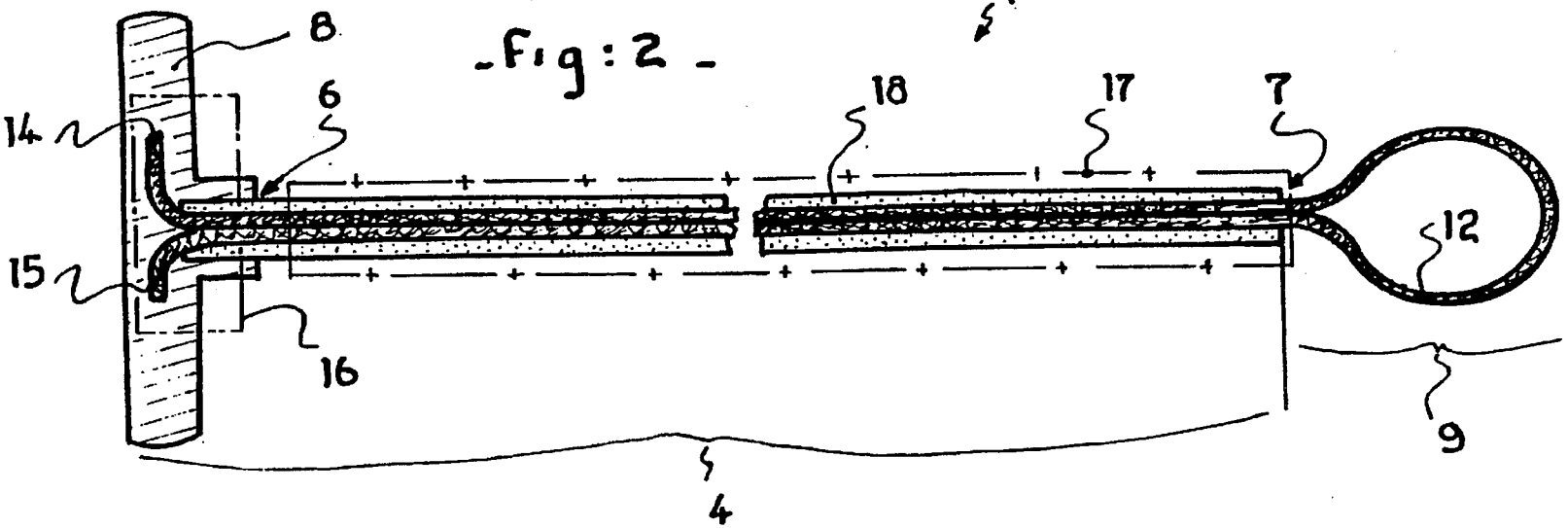
-Fig:2-

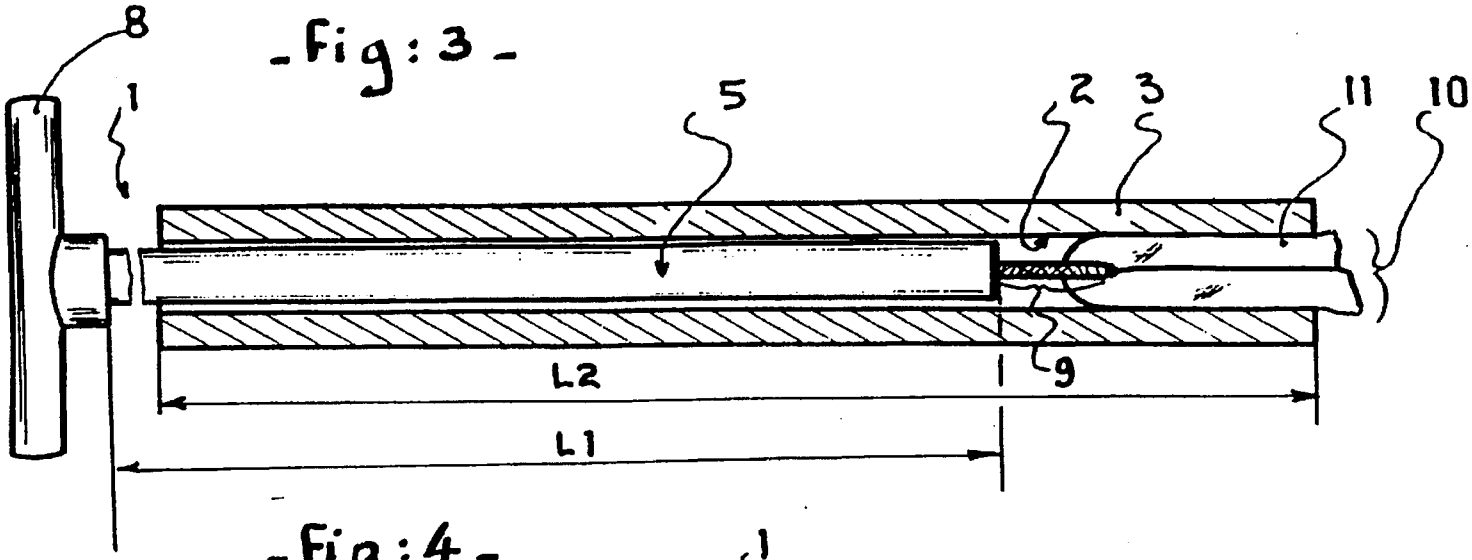
-Fig:3-
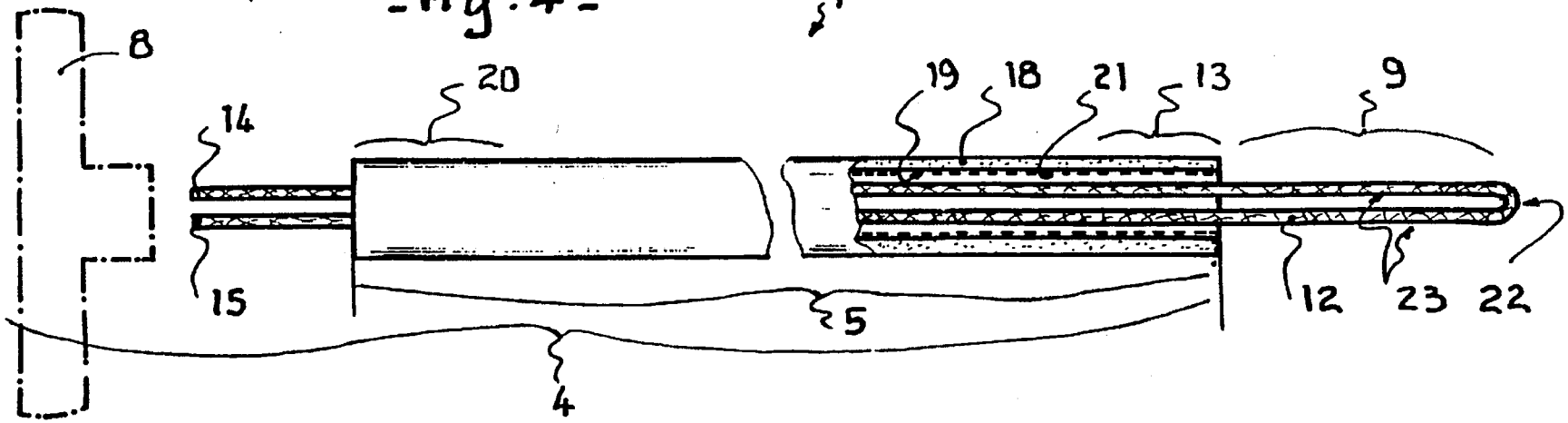
-Fig:4-

DEVICE FOR MAINTAINING THE INNER SURFACE OF GUN BARRELS AND METHOD FOR PRODUCING SAME

The invention relates to a device for the maintaining of inner surfaces of gun barrels.

The term guns is specifically understood to mean handguns and shoulder arms.

The term maintenance of the inner surface of a barrel is understood to indicate cleaning as well as lubrication of the inner surface for guiding projectiles fired by this barrel.

The invention also relates to a process for manufacturing the above-mentioned device.

In the field of firearms, it is customary, after using a gun, to remove the deposits of substances resulting from the sublimation of propulsive agents such as gunpowder which are deposited on the inner surface of the barrels during firing.

These deposits must be removed, since their accumulating and/or remaining in the barrel can impair the operation of the gun equipped with this barrel.

What is usually used to remove these deposits is a gun swab brush, that is, a device which essentially comprises, on the one hand, a movable member equipped with a handle and constituted by an elongated body which is longer than the barrel and can fit inside it, and on the other hand, a functional part such as a brush or a fiber swab attached to one of the ends of this body.

Generally, the elongated body consists of a rigid rod which is preferably constituted by an assembly of several sections so that it can be disassembled for storage in a small space.

Likewise, it is known that the elongated body is constituted by an assembly of elements articulated like chain links, each of the elements or links having a substantially cylindrical, rotating type of casing.

The brush used usually consists of a cylindrical brush with a diameter slightly larger than the internal diameter of the bore of the barrel which is attached, and specifically screwed, to the end of the movable member, with its longitudinal axis being substantially the same as that of the member.

As for the fiber swab, it is generally constituted by a fiber string held in place by a special piece attached, and specifically screwed, to the end of the movable member.

The term fiber string is understood to mean a scrap of fabric or a section of a cylindrical body constituted by bunch of fibers.

This special piece consists of a plate having a width slightly smaller than the internal diameter of the barrel and a minimal thickness which is limited in order to give it a certain mechanical strength, which plate includes an oblong slot through which the string is inserted before being folded so as to constitute the swab which must be inserted into the barrel.

This type of holding piece effectively ensures the intended operation, but the insertion of a fiber string into the oblong slot it contains requires a certain precision which cannot be obtained by an operator under certain conditions, particularly, for example, climatic conditions in which his fingers have been numbed by the cold.

Be that as it may, in order to clean the barrel, the passage of the functional part of the gun swab brush through the barrel is forced by action, and specifically by traction, on the body which carries it.

These known devices are particularly suitable for the maintenance of hunting guns with shotgun barrels, that is guns which are intended for firing lead shot and in which the internal diameter of the barrel approaches or even exceeds fifteen millimeters.

On the other hand, the maintenance of handguns, particularly those designed for firing ogival bullets, proves to be much more delicate, on the one hand by reason not only of the fact that the internal diameter of the barrel is smaller than that in guns of the above-mentioned type, but also the fact that the inner surface of the barrel has helicoidal grooves, and on the other hand because, for purposes of effectiveness, grooved barrels are preferably cleaned by means of a fiber string of the above-mentioned type.

The operator who cleans a low-caliber gun must therefore be especially careful not to jam the functional part of the gun swab brush inside the barrel.

This jamming phenomenon occurs particularly when the operator is inexperienced and forces the swab into the barrel by pulling and then pushing on it.

In order to avoid the jamming of the swab, or even its rupture as a result of too strong an action, it is customary to limit the size of the string used to a given value, but this has the disadvantage of resulting in insufficient cleaning of the gun.

An object of the invention is a cleaning device of the above-mentioned type which makes it possible to eliminate all of the indicated disadvantages of the known devices.

To this end, a subject of the invention is a device according to claim 1.

Another subject of the invention is a process for manufacturing a device of the above-mentioned type.

The invention will be thoroughly understood with the aid of the description below, given as a non-limiting example in reference to the appended drawing, which schematically represents:

FIG. 1: a view from above of a device according to the invention,

FIG. 2: a view in longitudinal section of the device according to FIG. 1, FIG. 3: a device according to the invention, during its utilization, FIG. 4: a device according to the invention, in the course of its manufacture.

The drawing shows a device 1 for maintaining the inner surface 2 of barrels 3 of guns (not represented) such as handguns or shoulder arms, that is a device 1 for cleaning and lubricating the surface 2 for guiding projectiles (not represented) fired by these barrels 3.

The device 1 essentially comprises:

- a movable member 4 constituted by an elongated body 5 which has two ends 6,7, one of which (6) is, for example, equipped with a pull handle 8, this body 5 having, on the one hand, a substantially uniform cross section whose dimensions are such that it can be loosely inserted into a barrel 3 with a given internal diameter, and on the other hand, a length L1 longer than that L2 of the barrel into which it must be inserted, and
- means such as closed loop 9 for anchoring a swab 10 of flexible material constituted by the folding of a string 11 whose cross section has a given contour, which are intended to be moved against the inner surface 2 of the barrel 3.

For example, the string 11 is composed of fibers and is sized. The string 11 may, more broadly, be referred to as a piece of flexible material.

Instead of being composed of a metallic plate with a width slightly smaller than the internal diameter of the barrel and with a minimal thickness which is limited so as endow it with a certain mechanical strength, which includes an oblong slot through which the material which constitutes the swab 10, such as a string 11, is inserted before being folded so as to constitute this swab. A means for anchoring the swab 10 is notably composed of a closed loop 9 which, on the one hand, is made from a flexible filamentary material such as cord 12, and on the other hand has, in the annular position, a contour which is considerably larger than that of the string 11 intended to constitute the swab 10. In other words, and as clearly shown by comparing FIG. 1 to FIG. 3, the contour of loop 9 in its annular position or unconstrained position (FIG. 1) is larger than the contour of the cross section of string 12.

This technical characteristic of the device allows the anchoring means 9 for inserting the string 11 to be deformed without any particular care or dexterity.

In one noteworthy embodiment, the loop 9 is constituted by the folding of at least one section of a cord 12.

In a preferred embodiment, the cord 12 is the textile type.

In an equally noteworthy way, the elongated body 5 of the device 1 is constituted by at least one cord 12 which, on the one hand, is locally folded and held in a given position relative to the contour by means 13 provided for this purpose, so as to constitute the loop 9 and, on the other hand, is connected to the pull handle 8.

According to one embodiment, the body 5 of the device includes at least one cord 12 which has two ends 14, 15, which cord is folded onto itself in such a way that:

on the one hand, these ends 14, 15 are joined and held inside means 16 situated at the level of the pull handle 8 and, on the other hand, the loop is situated midway along the length of the cord 12.

Notably:

the body of the device includes means 17 for stiffening the cord 12 they contain to such an extent that, on the one hand, the loop 9 can be easily inserted and pushed into a barrel 3 without producing any jamming caused by the bending of the body 5, and on the other hand, this body remains flexible enough to be coiled, the stiffening means 17 are composed of a sheath 17 with a tubular wall 18 in which the inner surface 19 of this wall 18 is tightly applied to the cord 12, the inner surface 19 of the sheath 17 and the cord 12 are bonded.

Notably:

the sheath 17 has two ends 13, 20 and, it is one of these ends 13 which constitutes the means 13 for holding the contour of the loop 9, the sheath 17, on the one hand, is made of a material which is heat-shrinkable at a given temperature and is applied to the cord 12 by means of heat-shrinking and, on the other hand, has an inner surface 19 coated with an adhesive 21 which is heat-fusible at a temperature substantially lower than the heat-shrinking temperature, and the means 16 for joining and holding the ends 14, 15 of the cord 12 at the level of the pull handle 8 are formed by the material which constitutes the handle 8, which material tightly encloses the ends, at least locally.

The adhesive 21 which coats the inner surface 19 of the sheath 17 is represented by dashed lines.

Advantageously, the handle 8 is made of molded material.

The invention also relates to a process for manufacturing a device 1 which is designed for maintaining the inner surface 2 of the barrels 3 of guns, and which essentially comprises:

a movable member 4 constituted by an elongated body 5 which has two ends 6, 7, one of which is equipped with a pull handle 8, this body 5 having, on the one hand, a substantially uniform cross section whose dimensions are such that it can be loosely inserted into a barrel 3 with a given internal diameter, and on the other hand, a length L1 longer than that L2 of the barrel into which it must be inserted, and means 9 for anchoring a swab 10 of flexible material constituted by the folding of a piece such as a fiber string 11 whose cross section has a given contour, which are intended to be moved against the inner surface 2 of the barrel 1.

Specifically, in order to produce this device 1:

it is necessary to provide, on the one hand, at least one cord 12 with a total length which is longer than double the length L2 of the barrel plus the contour of the string 11 and, on the other hand, a tubular sheath 17 whose wall 18 has a length which is at least equal to the length L2 of the barrel, and which is not only made of material which is heat-shrinkable at a given temperature and applied to the cord 12 by heat-shrinking but which also has an inner surface 19 coated with an adhesive 21 which is heat-fusible at a temperature substantially lower than the heat-shrinking temperature, the cord 12 is folded onto itself in such a way as to produce, on both sides of an end crease 22, two sides 23 of roughly equal length which are juxtaposed, the cord 12, folded in this way is inserted into the sheath 17 until it causes the protrusion of, on the one hand, at one end 13 of its ends 13, 20, the crease 22 thus formed, by a length roughly equal to half the contour of the loop 9 in the annular position, and on the other hand, at its other end 20, the free ends 14, 15, of the folded cord 12, the sheath 17 is heat-shrunk onto the sides of the cord 12.

the handle 8 of the device 1 is constituted by the molding of a material 24 for this purpose, and in so doing the means 16 for joining the handle 8 to the body 5 are constituted by enclosing in this molding material, on one hand, the ends 14, 15 of the cord 12 which protrude from the sheath 17 at its end 20 opposite the end 13 which includes the loop 9 and, on the other hand, this end 20 of the sheath 17.

The device manufactured in this way proves to be particularly strong.

I claim:

1. A device (1) for cleaning and lubricating projectile guiding inner surfaces of barrels of guns comprising:

a movable member (4) having an elongated body (5) with two ends (6,7), one of which (6) is equipped with a handle (8), said elongated body (5) having:

a substantially uniform cross section whose dimensions are such that it can be loosely inserted into a barrel with a given internal diameter; and a length which is longer than a length of the barrel with the given internal diameter and into which it must be inserted, means for anchoring a swab (10) of flexible material, the swab including a folded piece (11) whose cross section has a given contour, the swab being movable against an inner surface of a barrel, said means for anchoring the swab (10) including a closed loop (9), said closed loop being made of a flexible filamentary material (12), and said closed loop having an annular position wherein the closed loop has a contour larger than the contour of the material of the folded piece (11) of the swab (10); and wherein the body (5) has two ends (14, 15) of the flexible filamentary material (12) folded onto itself, in such a way that:

said ends (14, 15) of said flexible filamentary material are held to the handle (8), and said closed loop (9) is situated midway along the length of the flexible filamentary material (12).

2. The device according to claim 1 wherein material of the handle joins and holds the ends (14, 15) of the cord (12) at the handle (8), which material encloses said ends (14, 15) of the cord (12), at least locally.

3. The device according to claim 1 wherein the body (5) further includes a sheath (17) with a tubular wall (18) having an inner surface (19) against which said flexible filamentary material (12) bears, and the inner surface (19) of the sheath (17) and the flexible filamentary material (12) are bonded.

4. The device according to claim 3 wherein material of the handle joins and holds the ends (14, 15) of the cord (12) at the handle (8), which material encloses said ends (14, 15) of the cord (12), at least locally.

5. The device according to claim 3 wherein said sheath (17) has two ends (13, 20), one of which ends (13) holds the contour of the closed loop (9).

6. The device according to claim 5 wherein material of the handle joins and holds the ends (14, 15) of the cord (12) at the handle (8), which material encloses said ends (14, 15) of the cord (12), at least locally.

7. The device according to claim 5 wherein said flexible filamentary material is a cord, wherein the sheath (17) is made of a material which is heat-shrinkable at a given temperature and is applied to the cord by heat-shrinking, and wherein the inner surface (19) is coated with an adhesive (21) which is heat-fusible at a temperature lower than the heat-shrinking temperature.

8. The device according to claim 7 wherein material of the handle joins and holds the ends (14, 15) of the cord (12) at the handle (8), which material encloses said ends (14, 15) of the cord (12), at least locally.

9. A process for manufacturing a device (1) for maintaining inner surfaces of barrels of guns, the device having:

a movable member (4) having an elongated body (5) with two ends (6,7), one of which (6) is equipped with a handle (8), said elongated body (5) having:

a substantially uniform cross section whose dimensions are such that it can be loosely inserted into a barrel with a given internal diameter; and a length which is longer than a length of the barrel with the given internal diameter and into which it must be inserted, means for anchoring a swab (10) of flexible material, the swab including a folded piece (11) whose cross section has a given contour, the swab being movable against an inner surface of a barrel;

the steps comprising:

providing at least one cord (12) with a total length longer than double a length of a barrel to be cleaned added to the contour of the folded piece (11);

providing a tubular sheath (17) with a wall (18) having a length at least equal to the length of the barrel (3), the tubular sheath made of material which is heat-shrinkable at a given temperature;

coating an inner surface (19) of the tubular sheath with an adhesive (21) which is heat-fusible at a temperature lower than the given temperature;

folding the cord (12) onto itself in such a way as to form, on both sides of an end, two sides (23) of roughly equal length which are juxtaposed;

inserting the cord (12) into the sheath (17) until a portion of the cord protrudes out a first end of the sheath, thus forming a crease (22) in the cord and having a closed loop of the cord at the first end, and wherein the inserting of the cord results in two free ends (14, 15) of the cord (12) extending out a second end of the sheath;, after the inserting step, heat-shrinking the sheath (17) onto sides of the cord (12), and molding a material (24) to form a handle at the second end of the sheath by enclosing the two free ends (14, 15) of the cord (12).

10. The device according to claim 9 wherein said flexible material is a cord made of a flexible filamentary material, wherein the sheath (17) is made of a material which is heat-shrinkable at a given temperature and is applied to the cord by heat-shrinking, and wherein the inner surface (19) is coated with an adhesive (21) which is heat-fusible at a temperature lower than the heat-shrinking temperature.

* * * * *

UNITED STATES PATENT AND TRADEMARK OFFICE

CERTIFICATE OF CORRECTION

PATENT NO. : 5,657,570

DATED : August 19, 1997

INVENTOR(S) : Emmanuel Jean-Luc Henri SIGIER

It is certified that error appears in the above-indentified patent and that said Letters Patent is hereby corrected as shown below:

Item [76],
On Title Page, inventor's name should read -- Emmanuel Jean-Luc Henri Sigier --.

Signed and Sealed this

Thirteenth Day of January, 1998

Bruce Lehman

*Attest:*

BRUCE LEHMAN

*Attesting Officer*

*Commissioner of Patents and Trademarks*